United States Patent [19]

Suso

[11] Patent Number: 4,526,211

[45] Date of Patent: Jul. 2, 1985

[54] FABRIC SELVAGE END CUT PREVENTION CUTTER GUIDE

[75] Inventor: Norimitsu Suso, Konan, Japan

[73] Assignee: Shikishima Boseki Kabushiki Kaisha, Osaka, Japan

[21] Appl. No.: 526,068

[22] Filed: Aug. 24, 1983

[30] Foreign Application Priority Data

Aug. 24, 1982 [JP] Japan ..... 57-128365[U]

[51] Int. Cl.[3] ..... D03D 47/40

[52] U.S. Cl. ..... 139/430; 139/302

[58] Field of Search ..... 139/116, 429, 430, 450, 139/302, 303

[56] References Cited

U.S. PATENT DOCUMENTS 4,134,434 1/1979 Malasek et al. ..... 139/302

4,275,773 6/1981 Shibata ..... 139/302

FOREIGN PATENT DOCUMENTS 1410749 10/1968 Fed. Rep. of Germany ..... 139/302

*Primary Examiner*—Henry S. Jaudon

*Attorney, Agent, or Firm*—Armstrong, Nikaido, Marmelstein & Kubovcik

[57] ABSTRACT

A cutter guide wherein a fabric selvage end guide is provided at a fabric selvage end in close proximity to a cutter, and in forming a fringed selvage on a selvage end of a fabric by cutting weft threads after insertion in a shuttleless loom, the position of the guide being adjusted to accommodate a change in the width of a fabric being woven, so as to keep the guide in contact with the fabric selvage end, whereby the distance between the fabric selvage end and the cutter can be minimized.

3 Claims, 2 Drawing Figures

FABRIC SELVAGE END CUT PREVENTION CUTTER GUIDE

BACKGROUND OF THE INVENTION

This invention relates to a fabric selvage end cut prevention cutter guide in a shuttleless loom, e.g., a fluid jet type loom such as of the air jet picking type, and more particularly it relates to a cutter guide adapted to protect and guide a fabric selvage end so as to prevent the cutting of the fabric selvage end which is liable to occur when the ends of inserted weft threads are cut.

Fabrics produced by shuttleless looms have a fringed selvage at the fabric selvage end (or edge), the presence of which fringed selvage tends to detract from their market value as it makes them look unfavorable in comparison with fabrics which are produced by ordinary looms and which have no fringed selvage so that the selvage line can be distinctly and neatly exhibited. Therefore, to make them look as favorable as possible to increase their market value, it has been desired that the fringed selvage be trimmed as short as possible. To this end, it has been proposed to position the cutter as close to the fabric selvage end as possible so as to allow the cutting of weft threads to be effected in close proximity to the fabric selvage end. However, since a fabric being woven is influenced by such factors as warp thread tension, fabric take-up tension, and the temperature and humidity in the weaving room, whereby the fabric width changes more or less during weaving, there is a fear that if the fabric width increases, the fabric selvage end is caught by the blades of the cutter installed in close proximity thereto and is thereby cut. Therefore, it has been common practice to effect the cutting of inserted weft threads by installing the cutter at a position excessively remote from the fabric selvage end to the extent that the fabric selvage end is not cut. As a result, the fringed selvage lengthens and has its threads entwined with each other, detracting from the aesthetic value of the fabric and forming an obstacle to the subsequent treatment; it has been impossible to expect to eliminate such drawbacks.

SUMMARY OF THE INVENTION

An object of the invention is to provide a cutter guide, intended to eliminate the aforesaid drawbacks in looms of the described type, wherein in forming a fringed selvage on a selvage end of a fabric by cutting weft threads after insertion in a shuttleless loom, a fabric selvage end guide is provided at a fabric selvage end in close proximity to a cutter, the position of the guide being adjusted to accommodate a change in the width of a fabric being woven, so as to keep the guide in contact with the fabric selvage end, whereby the distance between the fabric selvage end and the cutter can be minimized.

According to this invention, a cutter guide is installed in such a manner that a fabric selvage end guide is positioned at a location where it contacts the fabric selvage end at a predictable minimum of fabric width to cope with a change in fabric width which takes place during weaving, whereby even if the fabric width increases, the fabric selvage end guide prevents the fabric selvage end from being caught by the cutter, and since the fabric selvage end travels in contact with the fabric selvage end guide as it is suppressed by the latter without being influenced by a change in fabric width, the distance between the fabric selvage end at the cutter position and the cutter is maintained at a constant value. Further, since the cutter integral with the fabric selvage end guide is positioned as close to the fabric selvage end as possible, the threads of the fringed selvage are trimmed short and neat and the selvage looks very good, increasing the market value of the woven fabric and making it possible to maintain the improved external appearance of the selvage during the subsequent treatment.

According to this invention, since it is only necessary to provide a conventional cutter with a fabric selvage end guide integrally therewith, the cutter guide is simple in construction and easy to manufacture. Further, the cutter guide is capable of preventing fabric selvage end cut and allowing a fringed selvage to be easily trimmed short and neat. Thus, the invention is of highly practical use.

DESCRIPTION OF THE PREFERRED EMBODIMENT

Figure 1:
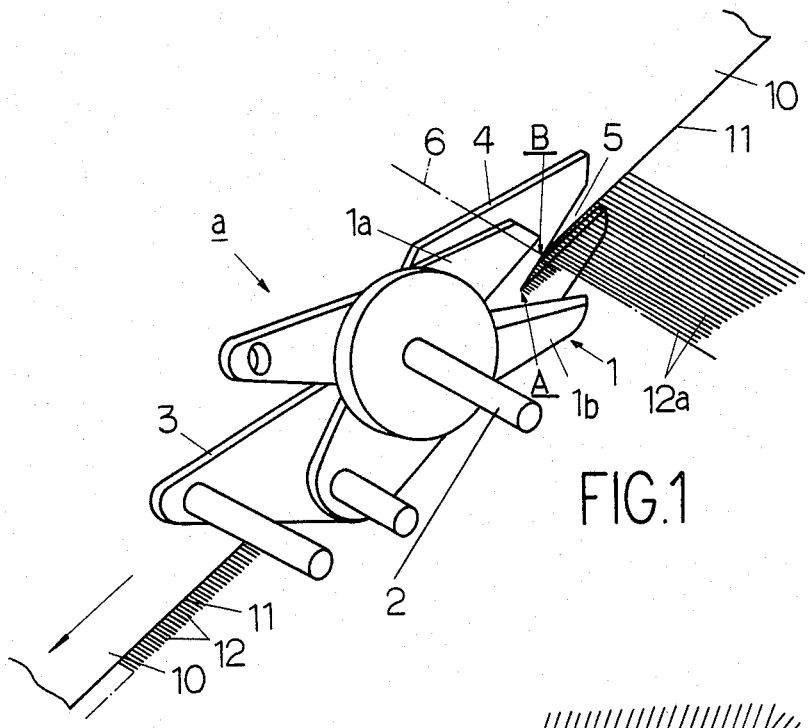
FIG. 1 is a perspective view of a cutter guide assembly according to this invention installed in position.

Usually, a shuttleless loom such as an air jet type loom, as shown in FIG. 1, is so arranged that inserted weft threads are cut by a cutter 1 adjacent a fabric selvage end to form a fringed selvage 12 at the fabric selvage end.

As shown in FIG. 1, the cutter 1 comprises upper and lower blades 1*a* and 1*b*, one of which is fixed, the other being movable (in the illustration, the upper blade being fixed), and a fabric selvage end guide 4 is interposed between said cutter 1 and a plate-like bracket 3 having a shaft 2 for fixing said cutter, thus forming an integral cutter guide assembly a.

The aforesaid fabric selvage end guide 4 is in the form of a plate formed at its front end with a guide groove cut like an acute angle and opening in the same direction as the opening and closing angle formed between the upper and lower blades 1*a* and 1*b* of the cutter 1 during cutting operation. The cutter guide assembly a is so positioned that the lateral surface of the fabric selvage end guide 4 is contacted at A with a fabric selvage end 11, as shown, which corresponds to a predictable minimum of fabric width when the fabric width changes during weaving, so as to introduce a plurality of uncut weft threads 12*a* into the guide groove 5.

As a result of this arrangement, the distance between the fabric selvage end 11 and the cutter 1 is maintained substantially at the shortest constant distance, and the fabric selvage end 11 travels in contact with the fabric selvage end guide 4 irrespective of a change in fabric width and will not be cut by the cutter 1, while the latter cuts the fringed selvage 12 to a minimum of length for uniform trimming to a constant length. That is, even if the fabric width decreases during weaving, since the fabric selvage end guide 4 is positioned where it contacts the fabric selvage end 11 corresponding to a predictable minimum of fabric width, the fabric selvage end 11 remains in contact with the fabric selvage end guide 4, so that there is no possibility of the fringed selvage becoming longer. Further, when the fabric width increases, the fabric selvage end 11 is contacted deep with the fabric selvage end guide 4, but at the cutting position of the cutter 1 a further approach to the cutter 1 is suppressed, so that the cut length of the fringed selvage 12 is constant, being the same as when the fabric width decreases.

In addition, in the above embodiment the fabric selvage end guide is in the form of a plate cut to form a V-shaped guide groove so as to have the function of easily and positively introducing uncut weft threads into the opening defined by the two blades 1*a* and 1*b* of the cutter. However, this fabric selvage end guide may be formed of a plate so that its front end is positioned adjacent the cutting point of the cutter. Further, when the fabric selvage end guide is installed between the cutter and the cutter fixing plate, besides being mounted on a cutter attaching shaft, it may be attached to the cutter attaching plate-like bracket or the bracket 3 itself may be configured to serve as a fabric selvage end guide. No matter what form it may take, it is only necessary that it be capable of being positioned as close to the fabric selvage end as possible without causing any trouble to the operation of the cutter and of positivly and easily introducing uncut weft threads at the fabric selvage end into the cutter section.

In addition, the fabric selvage end guide, besides being in the form of a plate, may be in the form of a bar or a rectangular prism, which is used as such or after being cut to form a groove for introducing uncut weft threads thereinto.

Figure 2:
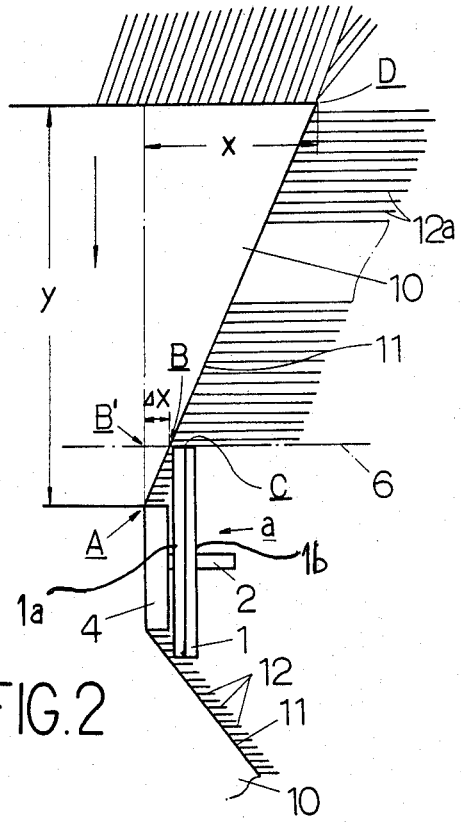
FIG. 2 is a plan view showing schematically the relationship of the operative elements to illustrate how a fringed selvage is trimmed.

The embodiment of this invention will now be outlined. The guide groove 5 cut in the fabric selvage end guide 4 is so positioned that, as shown in FIGS. 1 and 2, the acute angle tip A of the groove is located at a point deviated about 1.5 mm from the cutting point C of the cutter 1 (the crossing point of the cutting edges of blades 1*a* and 1*b*) in the direction of travel of the fabric. The open groove width of the guide groove 5 at the intersection B between a cutting point line 6 extending from the cutting point C in the direction of the fabric width and the guide groove 5 is smaller than the maximum open width of the cutter 1. This arrangement makes reliable the introduction of uncut weft threads 12*a* to the cutting point C of the cutter. Further, the fabric selvage end guide 4 together with the cutter 1 is positioned to contact the fabric selvage end 11 corresponding to a predictable minimum of fabric width.

Let y be the distance from the beating point D to the acute angle tip A of the cut guide groove 5 of the fabric selvage end guide, x be the maximum change in fabric width, B be the intersection between the cutting point line 6 and a line extending from the lateral surface of the fabric selvage end guide 4, and $\Delta x$ be the amount of change in the length of the fringed selvage 12.

Then, since $y=105$ mm, $x=4$ mm, and $AB'=1.5$ mm, the amount of change in the length of the fringed selvage is given by $$\Delta x = 1.5 \times 4/105 \approx 0.6 \approx 0$$

and $BC=B'C$, so that it is constant.

That is, the fabric selvage end B point on the cutting point line 6 is located substantially on the extension line from the lateral surface of the fabric selvage end guide nearer to the fabric selvage end. Thus, since the cutter guide is installed at a position where the fabric selvage end guide contacts the fabric selvage end at a minimum of fabric width in consideration of the amount of change in fabric width, the fabric selvage end guide accommodates or controls a change in fabric width so as to keep substantially constant the distance between the cutting point of the cutter and the fabric selvage end, thus making it possible to trim the fringed selvage as short as possible at a constant value without the danger of cutting the fabric selvage end.

What is claimed is:

1. A fabric selvage end cut prevention apparatus for a shuttleless loom producing a fabric having weft threads extending from a selvage, said apparatus comprising:

a selvage end cut guide assembly including a bracket adapted to be attached to said loom, a fabric selvage end guide supported on said bracket including a plate-like member formed at its front end with a V-shaped guide groove cut therein having an acute angle tip, and a cutter means comprising a fixed blade and a movable blade mounted on said bracket, said fixed blade and said movable blade forming a cutting point; and said assembly being attached to said loom at a position where a lateral surface of said fabric selvage end guide rests against a selvage of said fabric at the predicted minimum width of said fabric with said guide groove and said cutting blades arranged to receive said weft threads, said cutter means being positioned with its cutting point close to and slightly forward of said acute angle tip of said guide groove, whereby said fabric selvage end guide maintains said fabric selvage at a uniform distance from said cutting point so that regardless of any increase in fabric width said weft threads are trimmed to a uniformly short fringe and said selvage is separated from said cutting blades to prevent cutting of said selvage.

2. An apparatus as recited in claim 1 wherein the width of said guide groove adjacent said cutting point is smaller than the open width of said cutter blades.

3. The method of forming a fringed selvage in a fabric being woven on a shuttleless loom and having weft threads extending therefrom wherein said fabric may have a varying width, comprising the steps of:

providing a plate-like fabric selvage end guide on said loom at a position where a lateral surface of one side of said guide rests against a selvage of said fabric at its minimum width;

providing an elongated acute angle groove in said end guide positioned to receive and guide weft threads extending outwardly from said selvage into an acute angle tip of said groove;

providing a cutter means adjacent to said end guide on the side opposite from said fabric, said cutter means having a cutting point positioned so that a cutting point line extending from said cutting point in the direction of the fabric width passes slightly forward of said acute angle tip of said groove; and cutting said weft threads with said cutter means, whereby a selvage with a fringe of threads short and constant in length is formed irrespective of any variation in the fabric width.

* * * * *